US007104771B2

(12) United States Patent
Choi et al.

(10) Patent No.: US 7,104,771 B2
(45) Date of Patent: Sep. 12, 2006

(54) ECCENTRIC BUSH STRUCTURE IN RADIAL COMPLIANCE SCROLL COMPRESSOR

(75) Inventors: Se-Heon Choi, Seoul (KR); Byung-Kil Yoo, Seoul (KR); Yang-Hee Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 129 days.

(21) Appl. No.: 10/872,390

(22) Filed: Jun. 22, 2004

(65) Prior Publication Data

US 2005/0129553 A1 Jun. 16, 2005

(30) Foreign Application Priority Data

Dec. 16, 2003 (KR) ..... 10-2003-0091934

(51) Int. Cl.
*F04C 18/02* (2006.01)

(52) U.S. Cl. ..... 418/55.5; 418/55.1; 418/57; 418/151; 418/182

(58) Field of Classification Search ..... 418/55.1–55.6, 418/57, 151, 182
See application file for complete search history.

(56) References Cited

U.S. PATENT DOCUMENTS 4,580,956 A * 4/1986 Takahashi et al. ..... 418/55.5
4,838,773 A 6/1989 Noboru
5,104,302 A * 4/1992 Richardson, Jr. ..... 418/55.5
5,199,862 A 4/1993 Kondo et al.
5,378,129 A * 1/1995 Dunaevsky et al. ..... 418/55.5
5,458,472 A * 10/1995 Kobayashi et al. ..... 418/55.5
5,496,158 A * 3/1996 Barito et al. ..... 418/55.5
5,531,578 A 7/1996 Takemoto et al.
5,536,152 A * 7/1996 Kawahara et al. ..... 418/55.5
5,779,461 A * 7/1998 Iizuka et al. ..... 418/55.5
6,461,131 B1 * 10/2002 Chang ..... 418/55.5
6,676,391 B1 * 1/2004 Koo et al. ..... 418/55.5
2002/0001532 A1 1/2002 Chang

FOREIGN PATENT DOCUMENTS

JP 03074588 A * 3/1991
JP 4-175486 6/1992
JP 6-147145 5/1994
JP 10220369 A * 8/1998
JP 2000073970 A * 3/2000
JP 2003-343454 12/2003
KR 10 0183502 5/1999
KR 10 0371171 2/2003

OTHER PUBLICATIONS

English language Abstract of Korean 10-0183502.
English language Abstract of JP 2003-343454.
English language Abstract of JP 4-175486.
English language Abstract of JP 6-147145.
English language Abstract of Korean 10-0371171.

* cited by examiner

*Primary Examiner*—Theresa Trieu
(74) *Attorney, Agent, or Firm*—Greenblum & Bernstein, P.L.C.

(57) ABSTRACT

An eccentric bush structure in a radial compliance scroll compressor including an eccentric bush fitted around a crank pin eccentrically provided at an upper end of a crankshaft, crank pin and stopper holes provided at the eccentric bush, and a weight member adapted to increase a weight of the eccentric bush. The stopper hole overlaps with the crank pin hole such that a stopper received in the stopper hole is radially protruded into the crank pin hole toward a vertically-extending cut surface formed at the crank pin to selectively come into contact with the cut surface in accordance with a rotation of the crank pin.

8 Claims, 8 Drawing Sheets

ECCENTRIC BUSH STRUCTURE IN RADIAL COMPLIANCE SCROLL COMPRESSOR

BACKGROUND OF THE INVENTION

1. Field of the Invention

The present invention relates to a scroll compressor, and more particularly to an eccentric bush structure in a radial compliance scroll compressor, which is capable of enhancing a centrifugal force of an eccentric bush included in the scroll compressor during operation of the scroll compressor, while preventing the eccentric bush from rising axially.

2. Description of the Related Art

Generally, a scroll compressor includes upper and lower scrolls respectively provided with involute-shaped wraps engaged with each other. One of the scrolls performs an orbiting motion with respect to the other scroll to reduce the volume of spaces defined between the scrolls, thereby compressing gas confined in the spaces.

As such a conventional compressor, a radial compliance scroll compressor is known. In such a radial compliance scroll compressor, an orbiting scroll thereof is backwardly moved when liquid refrigerant, oil or foreign matter is introduced into compression chambers defined between the orbiting scroll and the other scroll, that is, a fixed scroll, thereby abnormally increasing the gas pressure in the compression chambers. In accordance with the backward movement of the orbiting scroll, it is possible to prevent the wraps of the scrolls from being damaged due to the abnormally increased gas pressure.

FIG. 1 is a sectional view illustrating the entire configuration of a conventional radial compliance scroll compressor.

As shown in FIG. 1, the conventional radial compliance scroll compressor includes a shell 1, and main and sub frames 2 and 3 respectively arranged in the shell 1 at upper and lower portions of the shell 1. A stator 4, which has a hollow structure, is interposed between the main and sub frames 2 and 3 within the shell 1.

A rotor 5 is arranged inside the stator 4 such that it rotates when current flows through the stator 4. A vertical crankshaft 6 extends axially through a central portion of the rotor 5 while being fixed to the rotor 5 so that it is rotated along with the rotor 5. The crankshaft 6 has upper and lower ends protruded beyond the rotor 5, and rotatably fitted in the main and sub frames 2 and 3, respectively. Thus, the crankshaft 6 is rotatably supported by the main and sub frames 2 and 3.

An orbiting scroll 7 is mounted to an upper surface of the main frame 2 in the shell 1. The orbiting scroll 7 is coupled, at a lower portion thereof, with the upper end of the crankshaft 6, which is protruded through the main frame 2, so that it performs an orbiting motion in accordance with rotation of the crankshaft 6. The orbiting scroll 7 is provided, at an upper portion thereof, with an orbiting wrap 7*a* having an involute shape. The orbiting wrap 7*a* extends upwardly from an upper surface of the orbiting scroll 7. A fixed scroll 8 is arranged on the orbiting scroll 7 in the shell 1 while being fixed to the shell 1. The fixed scroll 8 is provided, at a lower portion thereof, with a fixed wrap 8*a* adapted to be engaged with the orbiting wrap 7*a* of the orbiting scroll 7 such that compression chambers 22 are defined between the wraps 7*a* and 8*a*. With this configuration, when the orbiting scroll 7 performs an orbiting motion in accordance with rotation of the crankshaft 6, gaseous refrigerant is introduced into the compression chambers 22 in a sequential fashion, so that it is compressed.

For the orbiting motion thereof, the orbiting scroll 7 is eccentrically coupled to the crankshaft 6. For this eccentric coupling, the crankshaft 6 is provided with a crank pin 10 upwardly protruded from the upper end of the crankshaft 6 at a position radially spaced apart from the center of the upper end of the crankshaft 6 by a certain distance. Also, the orbiting scroll 7 is provided, at the lower portion thereof, with a boss 7*b* centrally protruded from a lower surface of the orbiting scroll 7. A bearing 11 is forcibly fitted in the boss 7*b*. Also, an eccentric bush 12 is rotatably fitted around the crank pin 10. The crank pin 10 of the crankshaft 6 is rotatably received in the boss 7*b* of the orbiting scroll 7 via the bearing 11 and eccentric bush 12, so that the orbiting scroll 7 is eccentrically coupled to the crankshaft 6.

As a rotation preventing mechanism for the orbiting scroll 7, an Oldham ring 9 is arranged between the main frame 2 and the orbiting scroll 7. An oil passage 6*a* extends vertically throughout the crankshaft 6. Upper and lower balance weight members are provided at upper and lower surfaces of the rotor 5, respectively, in order to prevent a rotation unbalance of the crankshaft 6 caused by the crank pin 10.

In FIG. 1, reference numerals 15 and 16 designate suction and discharge pipes, respectively, reference numerals 17 and 18 designate a discharge port and a discharge chamber, respectively, reference numeral 19 designates a check valve, reference numeral 20 designates oil, and reference numeral 21 designates an oil propeller.

When current flows through the stator 4, the rotor 5 is rotated inside the stator 4, thereby causing the crankshaft 6 to rotate. In accordance with the rotation of the crankshaft 6, the orbiting scroll 7 coupled to the crank pin 10 of the crankshaft 6 performs an orbiting motion with an orbiting radius defined between the center of the crankshaft 6 and the center of the orbiting scroll 7.

In accordance with a continued orbiting motion of the orbiting scroll 7, the compression chambers 22, which are defined between the orbiting wrap 7*a* and the fixed wrap 8*a*, are gradually reduced in volume, so that gaseous refrigerant sucked into each compression chamber 22 via the suction pipe 15 is compressed to high pressure. The compressed high-pressure gaseous refrigerant is subsequently discharged into the discharge chamber 18 via the discharge port 17. The compressed high-pressure gaseous refrigerant is then outwardly discharged from the discharge chamber 18 via the discharge pipe 16.

Meanwhile, when an abnormal increase in pressure occurs in the compression chambers 22 due to introduction of liquid refrigerant, oil or foreign matter into the compression chambers 22, the orbiting scroll 7 is radially shifted such that the orbiting wrap 7*a* is moved away from the fixed wrap 8*a*, due to the abnormally increased pressure. As a result, it is possible to prevent the wraps 7*a* and 8*a* from being damaged by the abnormally increased pressure.

In the radial compliance scroll compressor having the above mentioned configuration, the eccentric bush 12 is coupled to the crank pin 10 in the above mentioned manner, in order to vary the orbiting radius of the orbiting scroll 7. Also, the eccentric bush 12 generates a centrifugal force corresponding to an eccentricity thereof, that is, the distance between the center of the crank pin 10 and the center of the eccentric bush 12, during the orbiting motion of the orbiting scroll 7. By virtue of this centrifugal force, the eccentric bush 12 can perform a sealing function for the compression chambers 22.

FIG. 2 is an exploded perspective view illustrating a structure of the conventional eccentric bush.

As shown in FIG. 2, the eccentric bush 12 has a crank pin hole 12*b* so that it is rotatably fitted around the crank pin 10. When an abnormal increase in pressure occurs in the compression chambers 22, the eccentric bush 12 is rotated such that the orbiting scroll 7 is radially shifted to cause the orbiting wrap 7*a* to be moved away from the fixed wrap 8*a*.

In order to limit the rotation of the eccentric bush 12 to a predetermined angle, the crank pin 10 has a cutout having a D-shaped cross-section, and thus, a cut surface 10*a*, at one side thereof. The eccentric bush 12 also has a stopper hole 12*a* at one side of the crank pin hole 12*b*. A cylindrical stopper 23 is fitted in the stopper hole 12*a*. The stopper hole 12*a* is arranged such that it overlaps with the crank pin hole 12*b*, so that the cylindrical stopper 23 fitted in the stopper hole 12*a* is radially protruded into the crank pin hole 12*b*.

As mentioned above, the eccentric bush 12 generates a centrifugal force corresponding to an eccentricity thereof, that is, the distance between the center of the crank pin 10 and the center of the eccentric bush 12, during the orbiting motion of the orbiting scroll 7. By virtue of this centrifugal force, the eccentric bush 12 performs a sealing function for the compression chambers 22. This sealing function is provided only under a normal operation condition in which the centrifugal force generated by the eccentric bush 12 is larger than the pressure of gaseous refrigerant in the compression chambers 22. At a rotated position of the eccentric bush 12 where a centrifugal force smaller than the pressure of gaseous refrigerant in the compression chambers 22, the sealing function is lost.

Thus, the force to seal the compression chambers 22 is determined in accordance with the relation between the centrifugal force and the pressure of gaseous refrigerant in the compression chambers 22. It can be seen that the sealing force is increased as the centrifugal force is larger than the pressure of gaseous refrigerant in the compression chambers 22.

There may be various methods for controlling the sealing force. One method is to modify the structure of the crank pin 10 or eccentric bush 12. However, this method has a structural restriction because the structural modification of the crank pin 10 or eccentric bush 12 may cause the entire mechanism of the scroll compressor to be unbalanced. For this reason, only a limited structural modification of the crank pin 10 or eccentric bush 12 is possible.

Meanwhile, the eccentric bush 12 may be axially elevated during repeated forward and backward rotations thereof, due to various reasons, for example, a pressure difference between upper and lower ends of the eccentric bush 12 caused by dispersion of oil occurring at the upper end of the eccentric bush 12 during operation of the scroll compressor.

Such an axial elevation of the eccentric bush 12 causes a reduction in the contact area between the eccentric bush 12 and the crank pin 10, thereby causing a tilting phenomenon wherein the eccentric bush 12 is upwardly moved in a state of being inclined at one side thereof. Such a tilting phenomenon may cause an increase in friction generated between the eccentric bush 12 and the bearing 11, thereby degrading the performance and reliability of the scroll compressor.

SUMMARY OF THE INVENTION

The present invention has been made in view of the above mentioned problems, and an object of the invention is to provide an eccentric bush structure in a scroll compressor which is capable of enhancing a centrifugal force of an eccentric bush included in the scroll compressor during operation of the scroll compressor, while preventing the eccentric bush from rising axially.

Another object of the invention is to provide an eccentric bush structure in a scroll compressor which has a simple construction while being capable of achieving the above object.

In accordance with one aspect, the present invention provides an eccentric bush structure in a radial compliance scroll compressor including a crankshaft, and a crank pin eccentrically arranged at an upper end of the crankshaft, and provided with a cut surface, the eccentric bush structure comprising: an eccentric bush fitted around the crank pin; a crank pin hole provided at the eccentric bush, and adapted to receive the crank pin; a stopper hole provided at the eccentric bush at one side of the crank pin hole such that the stopper hole overlaps with the crank pin hole, the stopper hole receiving a stopper such that the stopper is radially protruded into the crank pin hole toward the cut surface to selectively come into contact with the cut surface in accordance with a rotation of the eccentric bush; and a weight member adapted to increase a weight of the eccentric bush.

In accordance with another aspect, the present invention provides an eccentric bush structure in a radial compliance scroll compressor including a crankshaft, and a crank pin eccentrically arranged at an upper end of the crankshaft, and provided with a cut surface, the eccentric bush structure comprising: an eccentric bush fitted around the crank pin; a crank pin hole provided at the eccentric bush, and adapted to receive the crank pin; a stop surface formed at a surface of the crank pin hole to selectively come into contact with the cut surface in accordance with a rotation of the eccentric bush; and a weight member adapted to increase a weight of the eccentric bush, and thus, to increase an eccentric amount of the eccentric bush.

In either case, the eccentric bush generates an increased centrifugal force during a rotation thereof in accordance with the weight thereof increased due to the weight member. As a result, the eccentric bush provides an increased force to seal compression chambers defined in the scroll compressor.

The weight member may be arranged on an outer peripheral surface of the eccentric bush at a position radially spaced apart from a center of the crank pin hole by a maximum distance. In accordance with such an arrangement, the weight member maximizes the centrifugal force of the eccentric bush, so that the eccentric amount of the eccentric bush is maximized.

The weight member may be formed on the outer peripheral surface of the eccentric bush at a lower end of the eccentric bush such that the weight member is integral with the eccentric bush. Accordingly, it is possible to simply manufacture the eccentric bush provided with the weight member. It is also possible to prevent the eccentric bush from rising axially during the operation of the scroll compressor.

Alternatively, the weight member may be separably attached to a coupling surface formed at the outer peripheral surface of the eccentric bush at a lower end of the eccentric bush. In this case, there is an advantage in that the eccentric bush can be more simply manufactured because the weight member is separate from the eccentric bush, in addition to an advantage of being capable of preventing the eccentric bush from rising axially. Also, it is possible to easily achieve replacement of the weight member with a heavier or lighter one or a new one.

The weight member may extend radially from the outer peripheral surface of the eccentric bush while having a small thickness. Accordingly, the eccentric bush can be easily installed in the scroll compressor. It is also possible to prevent the eccentric bush from rising axially, while preventing the eccentric bush from performing an unbalanced orbiting motion due to the weight member.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Now, embodiments of an eccentric bush structure in a radial compliance scroll compressor according to the present invention will be described with reference to the annexed drawings.

Figure 3:
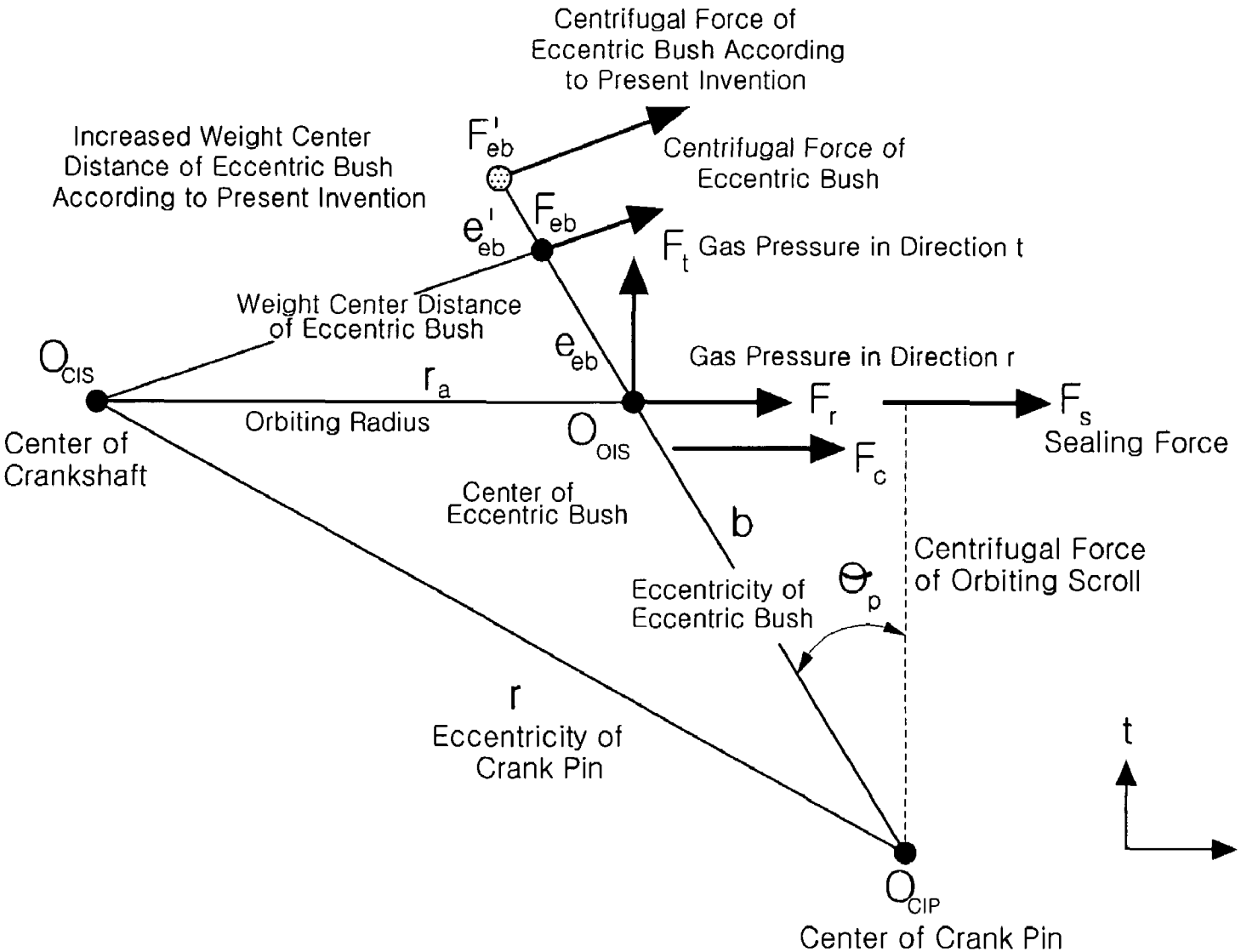
FIG. 3 is a kinetics diagram depicting a relation between a centrifugal force and a sealing force in a radial compliance scroll compressor using an eccentric bush structure according to the present invention.

FIG. 3 is a kinetics diagram depicting a relation between a centrifugal force and a sealing force in a radial compliance scroll compressor using an eccentric bush structure according to the present invention.

In a radial compliance scroll compressor, a crankshaft is rotated in accordance with rotation of a rotor. In accordance with the rotation of the crankshaft, an orbiting scroll, which is coupled to the crankshaft via a crank pin eccentrically mounted to the crankshaft, performs an orbiting motion with an orbiting radius defined between the center of the crankshaft and the center of the orbiting scroll, in a state of being engaged with a fixed scroll. In accordance with a continued orbiting motion of the orbiting scroll, compression chambers defined between the orbiting scroll and the fixed scroll are reduced in volume, so that gaseous refrigerant sucked into the compression chambers is compressed.

In order to prevent wraps of the orbiting scroll and fixed scroll from being damaged due to an excessive compression in the compression chambers, the radial compliance scroll compressor employs an eccentric bush coupled to the crank pin, and adapted to vary the orbiting radius of the orbiting scroll. The eccentric bush generates a centrifugal force corresponding to an eccentricity thereof, that is, the distance between the center of the crank pin and the center of the eccentric bush, during the orbiting motion of the orbiting scroll. By virtue of this centrifugal force, the compression chambers are sealed. Thus, the force to seal the compression chambers is determined in accordance with the relation between the centrifugal force and the pressure of gas in the compression chambers.

FIG. 3 illustrates the relation between the centrifugal force and the pressure of gas in the compression chambers. Referring to FIG. 3, the eccentricity of the eccentric bush, b, corresponds to the distance between the center of the crank pin, $O_{CIS}$, and the center of the eccentric bush, $O_{OIS}$. The eccentricity of the crank pin, γ, corresponds to the crank pin center and the center of the crankshaft, $O_{CIS}$. The orbiting radius of the orbiting scroll corresponds to the distance between the crankshaft center $O_{CIS}$ and the eccentric bush center $O_{OIS}$.

The gas pressure in the compression chambers is divided into a gas pressure in a direction t, $F_t$, and a gas pressure in a direction r, $F_r$. The sealing force $F_S$ corresponds to the centrifugal force of the orbiting scroll, $F_C$.

The centrifugal force $F_{eb}$ of the eccentric bush is proportional to a distance between the center of weight of the eccentric bush and the center of the eccentric bush $O_{OIS}$, that is, a weight center distance $e_{eb}$ of the eccentric bush. That is, the centrifugal force $F_{eb}$ of the eccentric bush is increased as the weight center distance $e_{eb}$ of the eccentric bush increases.

In accordance with the present invention, the weight center distance of the eccentric bush is increased from the distance "$e_{eb}$" by a distance "$e'_{eb}$". As a result, the centrifugal force of the eccentric bush is increased from "$F_{eb}$" to "$F'_{eb}$" in accordance with the present invention. Thus, an increased sealing force $F_S$ is obtained.

The following Expression 1 is an equation for calculating a sealing force $F_S$ in conventional cases, whereas the following Expression 2 is an equation modified from Expression 1 to calculate a sealing force $F_S$ in a case, to which the present invention is applied. Referring to Expressions 1 and 2, it can be seen that the weight center distance of the eccentric bush is increased from the distance "$e_{eb}$" by the distance "$e'_{eb}$" in accordance with the present invention, that is, it corresponds to the sum of the distances "$e_{eb}$" and "$e'_{eb}$". It can also be seen that the centrifugal force of the eccentric bush is increased to "$F'_{eb}$" by virtue of the increased weight center distance of the eccentric bush, so that the sealing force $F_S$ is increased.

$$F_S = F_C + F_r + F_1 b \cdot \tan\theta_p + F_{eb}\left(1 + \frac{e_{eb}}{b}\right)(1 + \tan\theta_p) \quad \text{[Expression 1]}$$

$$F_S = F_C + F_r + F_1 b \cdot \tan\theta_p + F'_{eb}\left(1 + \frac{e_{eb} + e'_{eb}}{b}\right)(1 + \tan\theta_p) \quad \text{[Expression 2]}$$

Meanwhile, an increase in mass occurs as the weight center distance of the eccentric bush is increased from the distance "$e_{eb}$" by the distance "$e'_{eb}$".

Figure 1:
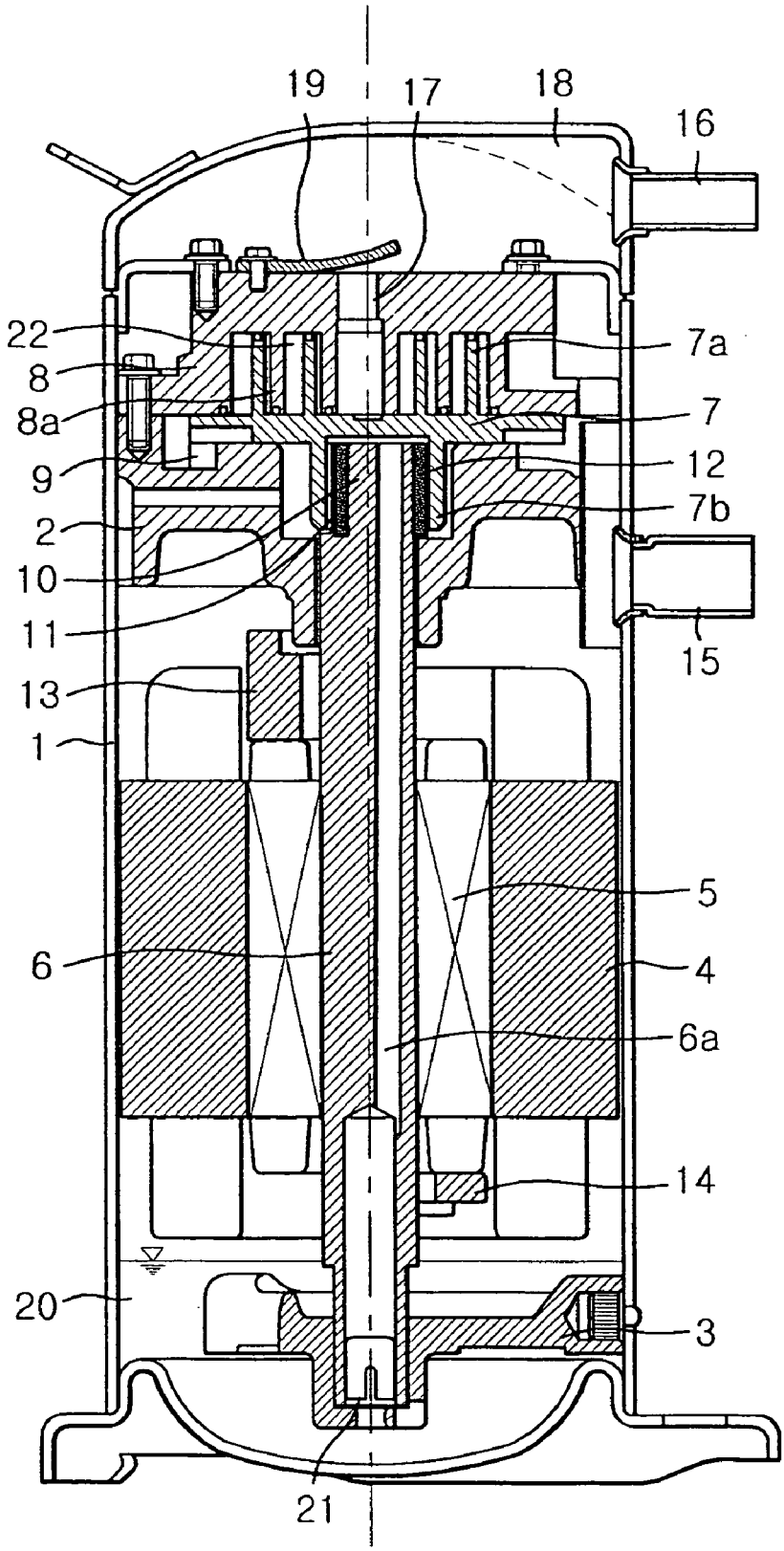
PRIOR ART FIG. 1
FIG. 1 is a sectional view illustrating the entire configuration of a conventional radial compliance scroll compressor.
Figure 2:
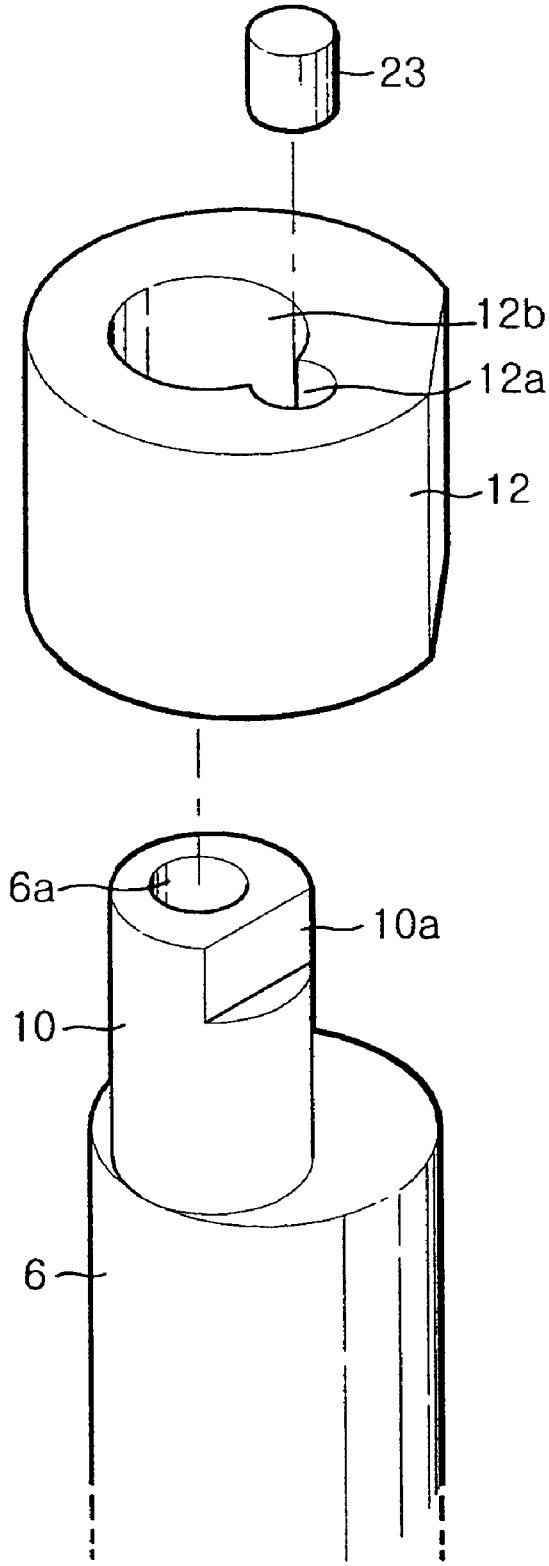
FIG.2 PRIOR ART
FIG. 2 is an exploded perspective view illustrating a structure of the conventional eccentric bush.
Figure 4:
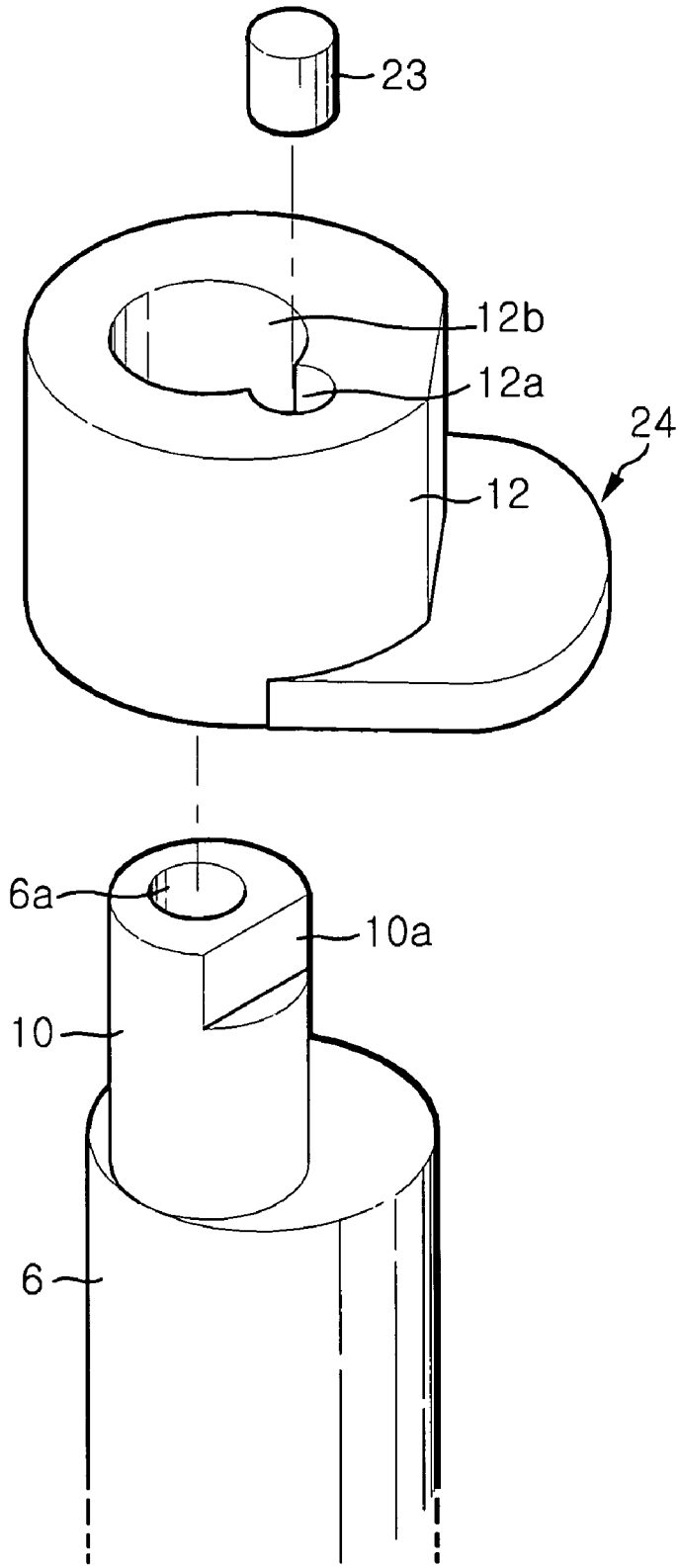
FIG. 4 is an exploded perspective view illustrating an eccentric bush structure according to an embodiment of the present invention.

FIG. 4 is an exploded perspective view illustrating an eccentric bush structure according to an embodiment of the present invention. The eccentric bush structure may be applied to the radial compliance scroll compressor shown in FIG. 1. In order to simplify the description thereof, the eccentric bush structure will be described in conjunction with the case in which it is applied to the radial compliance scroll compressor shown in FIG. 1. In FIG. 4, elements respectively corresponding to those in FIGS. 1 and 2 will be designated by the same reference numerals.

As shown in FIG. 4, the eccentric bush structure according to the illustrated embodiment of the present invention includes an eccentric bush 12 fitted around the crank pin 10 of the crankshaft 6, a crank pin hole 12*b* formed at the eccentric bush 12 to extend vertically throughout the eccentric bush 12, a stopper hole 12*a* formed at the eccentric bush 12 near the crank pin hole 12*b* to extend vertically into the eccentric bush 12, and a weight member 24 provided at an outer surface of the eccentric bush 12 such that it is integral with the eccentric bush 12.

The crank pin hole 12*b* receives the crank pin 10 such that the crank pin 10 is rotatable therein. The crank pin 10 extends upwardly from an upper end surface of the crankshaft 6 such that it is eccentrically arranged with respect to the crankshaft 6. The crank pin 10 is provided, at one side thereof, with a cutout formed at an upper portion of the crank pin 10 while having a D-shaped cross-section, and thus, a cut surface 10*a*. A cylindrical stopper 23 is fitted in the stopper hole 12*a*. The stopper hole 12*a* is arranged such that it overlaps with the crank pin hole 12*b*, so that the cylindrical stopper 23 fitted in the stopper hole 12*a* is radially protruded into the crank pin hole 12*b*. In accordance with this arrangement, the stopper 23 can come into contact with the cut surface 10*a* in accordance with rotation of the crank pin 10.

Since the stopper 23 fitted in the stopper hole 12*a* can come into contact with the cut surface 10*a* in accordance with rotation of the crank pin 10, the rotation of the eccentric bush 12 is limited to a certain range.

The weight member 24 serves to increase the weight of the eccentric bush 12, thereby increasing a centrifugal force caused by rotation of the eccentric bush 12. By virtue of the increased centrifugal force, the sealing force provided by the eccentric bush 12 is increased. Accordingly, it is possible to reliably prevent leakage of gas from occurring in the scroll compressor.

The weight member 24 is arranged on the outer peripheral surface of the eccentric bush 12 at a position radially spaced apart from the center of the crank pin hole 12*b* by a maximum distance. By virtue of this arrangement of the weight member 24, the weight of the eccentric portion of the eccentric bush 12 is increased, so that the eccentric amount of the eccentric bush is increased.

In particular, the weight member 24 is formed on the outer peripheral surface of the eccentric bush 12 at a lower end of the eccentric bush 12 such that it is integral with the eccentric bush 12. Accordingly, it is possible to simply manufacture the eccentric bush 12. It is also possible to prevent the eccentric bush 12 from rising axially.

In accordance with the illustrated embodiment of the present invention, the weight member 24 extends radially outwardly from the eccentric bush 12 to have a reduced thickness. Accordingly, the eccentric bush 12 can be easily installed in the radial compliance scroll compressor. In accordance with this construction, the weight member 24 comes into contact with a facing part of the scroll compressor when the eccentric bush 12 tends to rise axially, thereby preventing the eccentric bush 12 from rising axially.

Figure 5:
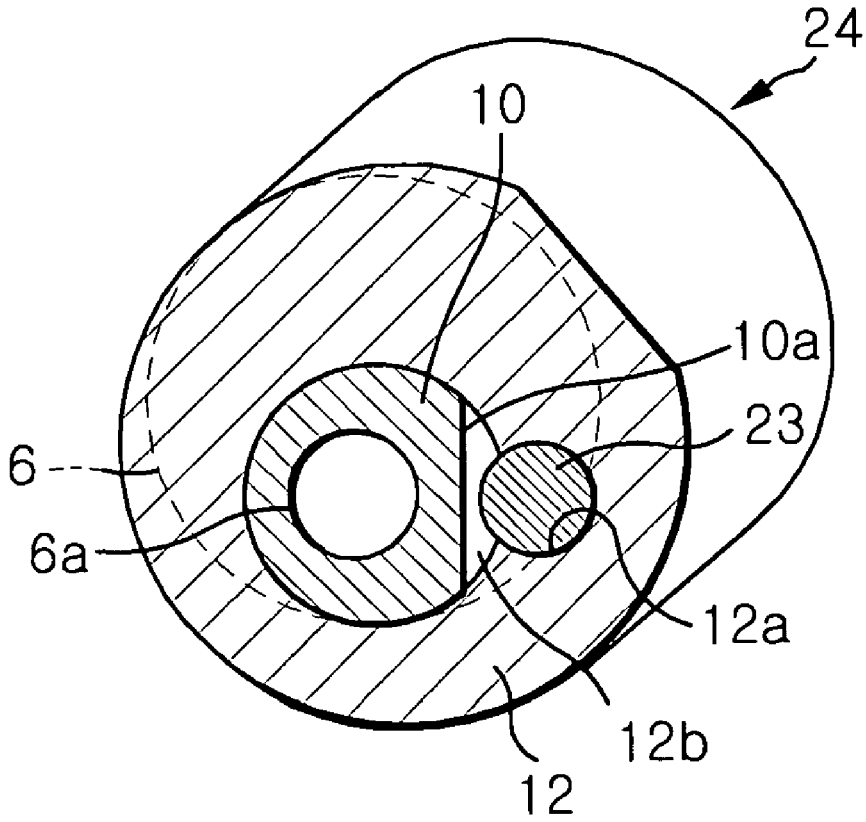
FIG. 5 is a cross-sectional view illustrating an assembled state of the eccentric bush structure shown in FIG. 4.

FIG. 5 is a cross-sectional view illustrating an assembled state of the eccentric bush structure shown in FIG. 4.

As shown in FIG. 5, the weight member 24 is arranged such that it is symmetrical to the eccentric bush 12 with respect to a central plane passing the center of the eccentric bush 12.

Since the weight member 24 is symmetrical to the eccentric bush 12, the eccentric bush 12 has a balanced weight. Accordingly, it is possible to prevent the eccentric bush 12 from performing an unbalanced orbiting motion due to the weight member 24.

Figure 6:
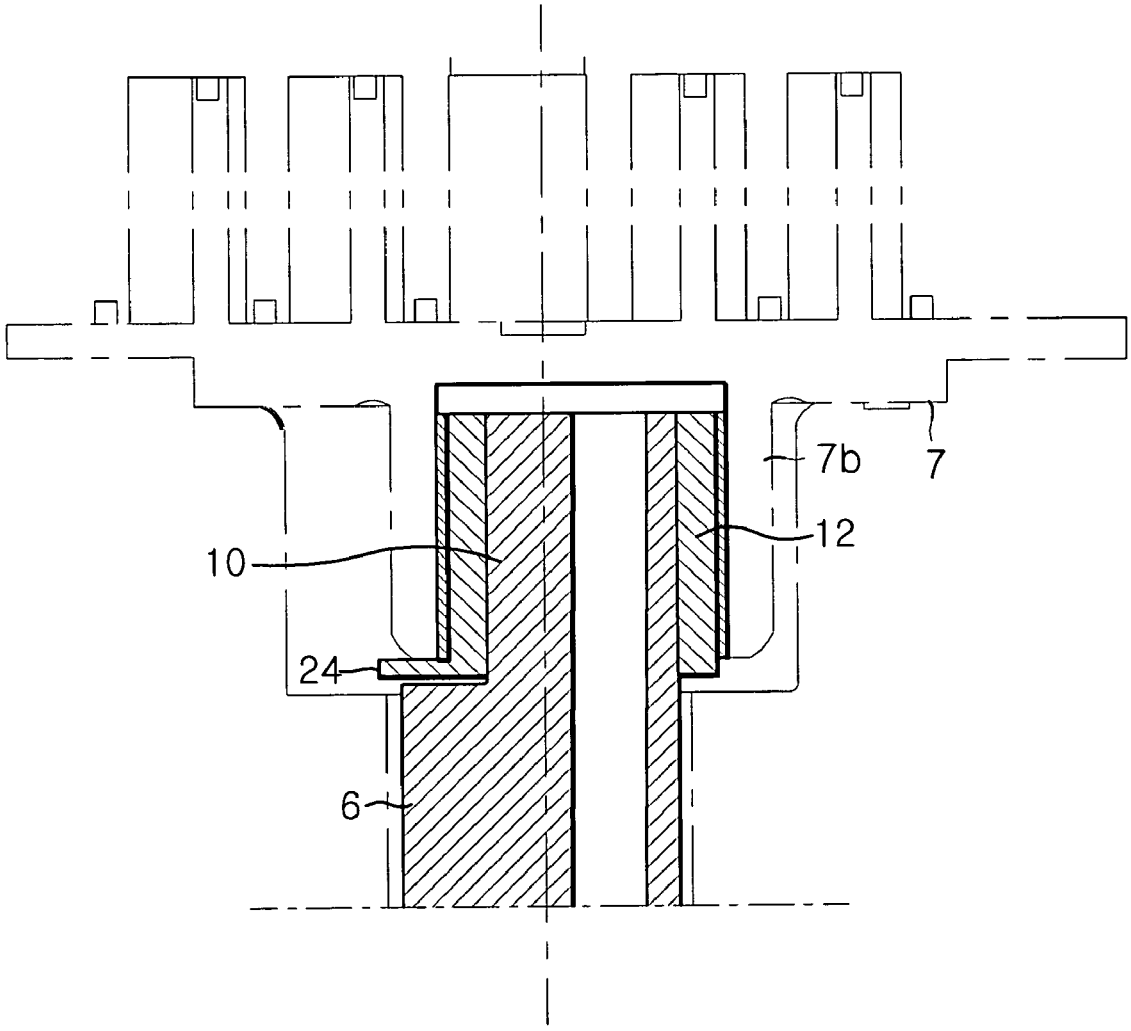
FIG. 6 is a sectional view illustrating the assembled state of the eccentric bush structure shown in FIG. 4.

FIG. 6 is a sectional view illustrating the assembled state of the eccentric bush structure shown in FIG. 4.

As shown in FIG. 6, the weight member 24 is protruded from the lower end of the eccentric bush 12 in a radially outward direction of the orbiting scroll 7.

Although the eccentric bush 12 tends to rise axially during a rotation thereof carried out in accordance with an operation of the radial compliance scroll compressor, the weight member 24 comes into contact with a facing part of the scroll compressor, that is, a lower end of the boss 7*b*, during the rotation of the eccentric bush 12, thereby preventing the eccentric bush 12 from rising axially.

As the eccentric bush 12 is prevented from rising axially, it is possible to prevent a tilting phenomenon wherein the eccentric bush 12 is upwardly moved in a state of being inclined at one side thereof. Since such a tilting phenomenon is prevented, the radial compliance scroll compressor can exhibit improvements in compression efficiency, performance, and reliability.

Figure 7:
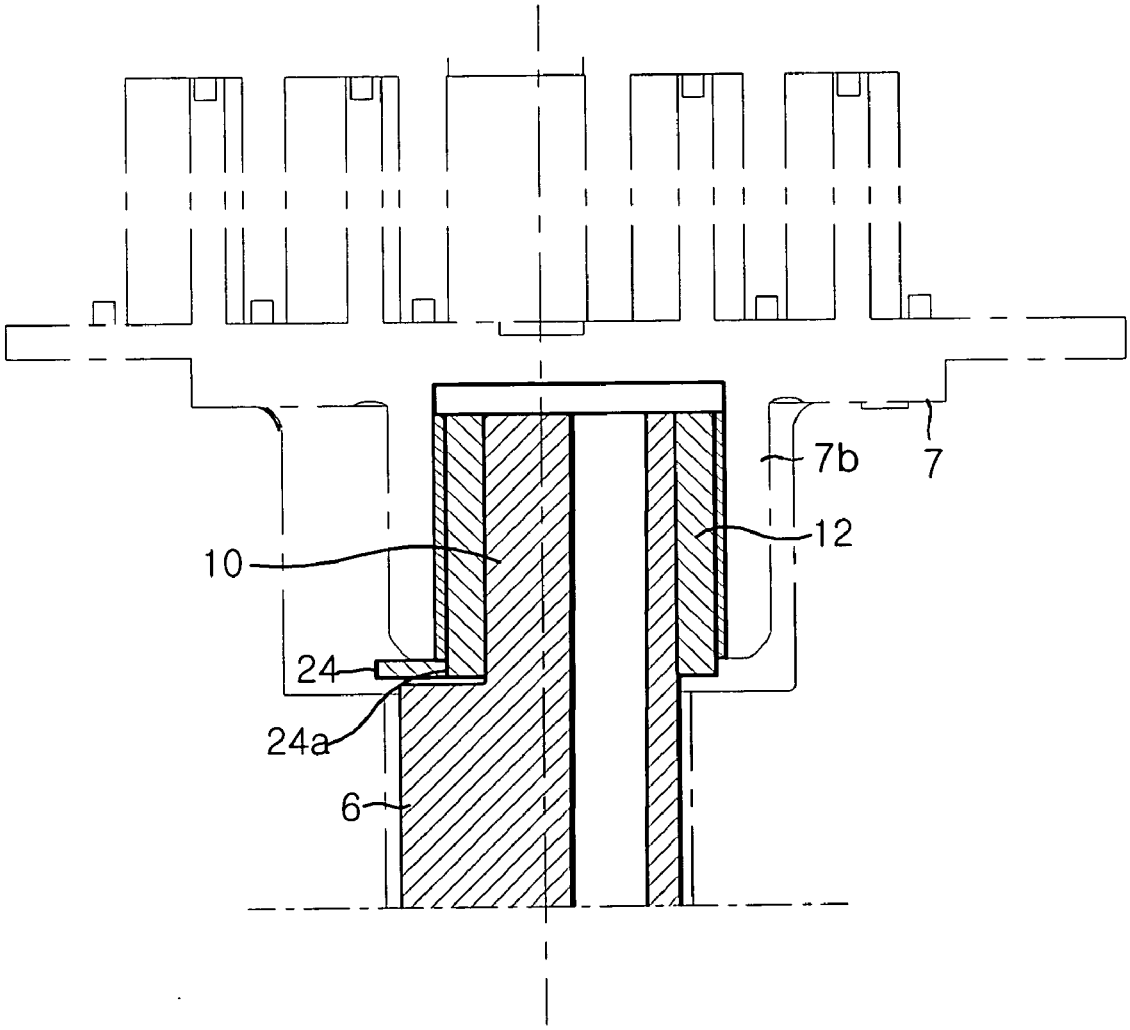
FIG. 7 is a sectional view illustrating an eccentric bush structure according to another embodiment of the present invention.

FIG. 7 is a sectional view illustrating an eccentric bush structure according to another embodiment of the present invention. In FIG. 7, elements respectively corresponding to those in FIGS. 4 to 6 will be designated by the same reference numerals.

In accordance with the embodiment illustrated in FIG. 7, the weight member 24 is separate from the eccentric bush 12. In this case, the weight member 24 is attached to a coupling surface 24*a* formed on the outer peripheral surface of the eccentric bush 12 at the lower end of the eccentric bush 12. The attachment of the weight member 24 is carried out in an assembled state of the eccentric bush 12.

Since the weight member 24, which is separate from the eccentric bush 12, is attached to the coupling surface 24*a* of the eccentric bush 12, it is possible to simply achieve the process of assembling the eccentric bush 12. It is also possible to easily achieve the replacement of the weight member 24 with a heavier or lighter one or a new one.

The attachment of the weight member 24 to the coupling surface 24*a* may be achieved using various methods. For example, a welding process may be used.

The concept of the present invention relating to the attachment of the weight member 24 is that the weight member 24 is separate from the eccentric bush 12, and it is attached to the outer peripheral surface of the eccentric bush 12 in an assembled state of the eccentric bush 12. Accordingly, the attachment of the weight member 24 may be achieved using various attaching or mounting methods within the concept of the present invention.

Figure 8:
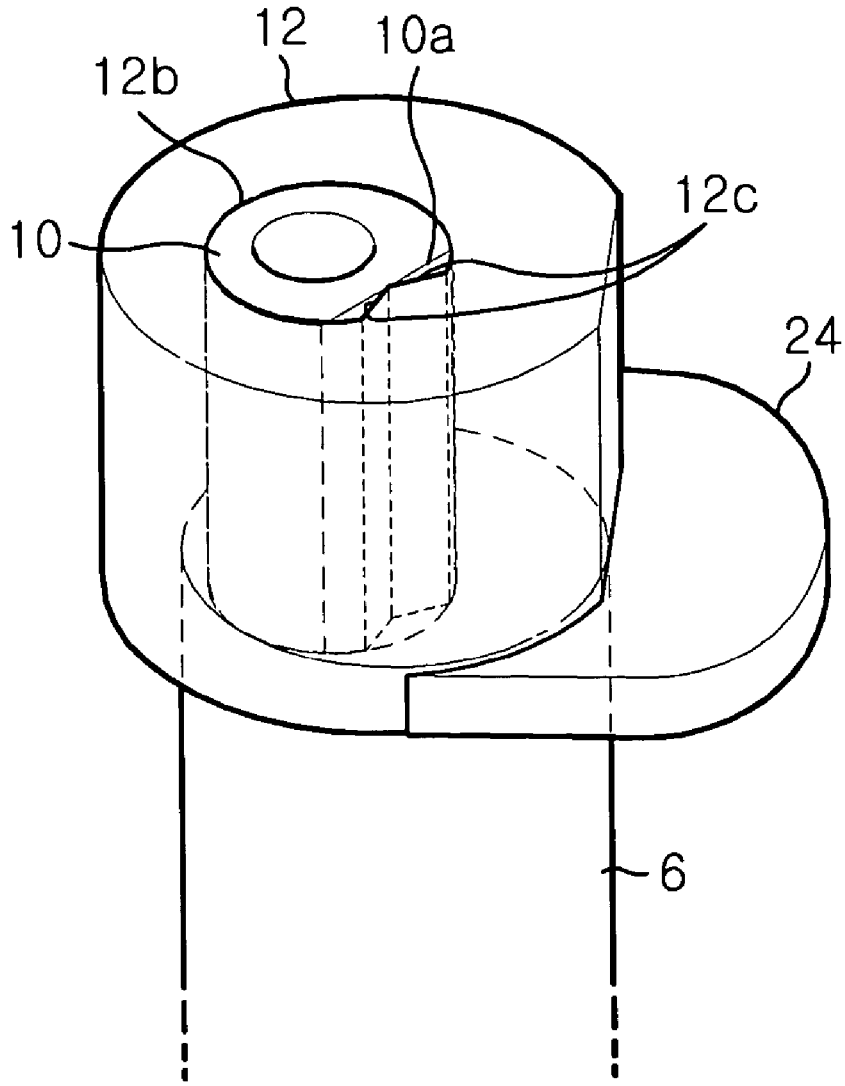
FIG. 8 is a perspective view illustrating an eccentric bush structure according to another embodiment of the present invention.

FIG. 8 is a perspective view illustrating an eccentric bush structure according to another embodiment of the present invention. In FIG. 7, elements respectively corresponding to those in FIGS. 4 to 6 will be designated by the same reference numerals.

As shown in FIG. 8, the eccentric bush structure according to the illustrated embodiment of the present invention includes an eccentric bush 12 fitted around the crank pin 10 of the crankshaft 6, a crank pin hole 12*b* formed at the eccentric bush 12 to extend vertically throughout the eccentric bush 12, a stop surface 12*c* formed at a surface of the crank pin hole 12*b*, and a weight member 24 provided at an outer surface of the eccentric bush 12 such that it is integral with the eccentric bush 12.

The crank pin hole 12*b* receives the crank pin 10 such that the crank pin 10 is rotatable therein. The crank pin 10 extends upwardly from an upper end surface of the crankshaft 6 such that it is eccentrically arranged with respect to the crankshaft 6. The crank pin 10 is provided, at one side thereof, with a cutout formed at an upper portion of the crank pin 10 while having a D-shaped cross-section, and thus, a cut surface 10*a*. In accordance with this arrangement, the stop surface 12*c* can come into contact with the cut surface 10*a* in accordance with rotation of the crank pin 10. Accordingly, the rotation of the eccentric bush 12 is limited to a certain range.

The weight member 24 serves to increase the weight of the eccentric bush 12, thereby increasing a centrifugal force caused by rotation of the eccentric bush 12. By virtue of the increased centrifugal force, the sealing force provided by the eccentric bush 12 to seal the compression chambers of the scroll compressor is increased. Accordingly, it is possible to reliably prevent leakage of gas from occurring in the compression chambers of the scroll compressor. The weight member 24 is radially outwardly protruded from the outer peripheral surface of the eccentric bush 12 at a lower end of the eccentric bush 12. Accordingly, it is possible to prevent a tilting phenomenon from occurring in the scroll compressor.

In accordance with this embodiment, the weight member 24 is arranged such that it is symmetrical to the eccentric bush 12. Accordingly, it is possible to prevent the eccentric bush 12 from performing an unbalanced orbiting motion due to an unbalanced weight thereof.

As apparent from the above description, the present invention provides an eccentric bush structure in a radial compliance scroll compressor which is capable of preventing an eccentric bush thereof from rising axially during an operation of the scroll compressor while achieving an increase in the centrifugal force of the eccentric bush. In accordance with the eccentric bush structure, it is possible to obtain an increased force for sealing compression chambers defined in the scroll compressor while preventing a tilting phenomenon caused by an axial elevation of the eccentric bush. As a result, there are improvements in the compression efficiency, performance and reliability of the scroll compressor.

In accordance with the present invention, the eccentric bush structure has a simple construction, so that there are an improvement in workability and a reduction in manufacturing costs.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An eccentric bush structure in a radial compliance scroll compressor, the eccentric bush structure comprising:

an eccentric bush fitted around a crank pin eccentrically arranged at an upper end of a crankshaft, the crank pin having a flat peripheral surface;

a crank pin hole provided in the eccentric bush, and configured to receive the crank pin;

a stopper hole provided in the eccentric bush at one side of the crank pin hole such that the stopper hole overlaps with the crank pin hole, the stopper hole receiving a stopper such that the stopper radially protrudes into the crank pin hole toward the flat surface of the crank pin to selectively come into contact with the flat surface in accordance with a rotation of the eccentric bush; and a weight configured to increase a weight of the eccentric bush, and increase an eccentric amount of the eccentric bush, wherein the weight is arranged on an outer peripheral surface of the eccentric bush at a position radially spaced from a center of the crank pin hole by a maximum distance.

2. The eccentric bush structure according to claim 1, wherein the weight is formed on the outer peripheral surface of the eccentric bush at a lower end of the eccentric bush such that the weight is integral with the eccentric bush.

3. The eccentric bush structure according to claim 1, wherein the weight is separably attached to a coupling surface formed at the outer peripheral surface of the eccentric bush at a lower end of the eccentric bush.

4. The eccentric bush structure according to claim 1, wherein the weight extends radially from the outer peripheral surface of the eccentric bush and has a small thickness.

5. An eccentric bush structure in a radial compliance scroll compressor, the eccentric bush structure comprising:

an eccentric bush fitted around a crank pin eccentrically arranged at an upper end of a crankshaft, the crank pin having a flat peripheral surface;

a crank pin hole provided in the eccentric bush, and configured to receive the crank pin;

a stop surface formed on a surface of the crank pin hole to selectively come into contact with the flat surface of the crank pin in accordance with a rotation of the eccentric bush; and a weight configured to increase a weight of the eccentric bush, and increase an eccentric amount of the eccentric bush, wherein the weight is arranged on an outer peripheral surface of the eccentric bush at a position radially spaced from a center of the crank pin hole by a maximum distance.

6. The eccentric bush structure according to claim 5, wherein the weight is formed on the outer peripheral surface of the eccentric bush at a lower end of the eccentric bush such that the weight is integral with the eccentric bush.

7. The eccentric bush structure according to claim 5, wherein the weight is separably attached to a coupling surface formed at the outer peripheral surface of the eccentric bush at a lower end of the eccentric bush.

8. The eccentric bush structure according to claim 5, wherein the weight extends radially from the outer peripheral surface of the eccentric bush such and has a small thickness.

* * * * *